US009993675B2

(12) United States Patent
Groen et al.

(10) Patent No.: US 9,993,675 B2
(45) Date of Patent: Jun. 12, 2018

(54) PRE-ACTION SPRINKLER HEAD

(71) Applicant: R&D Fire Solutions Inc., Brampton (CA)

(72) Inventors: David Ryan Groen, Guelph (CA); Randal John Bird, London (CA)

( * ) Notice: Subject to any disclaimer, the term of this patent is extended or adjusted under 35 U.S.C. 154(b) by 19 days.

(21) Appl. No.: 14/939,379

(22) Filed: Nov. 12, 2015

(65) Prior Publication Data

US 2016/0136471 A1 May 19, 2016

Related U.S. Application Data

(60) Provisional application No. 62/079,691, filed on Nov. 14, 2011.

(51) Int. Cl.
*A62C 37/14* (2006.01)
*A62C 37/40* (2006.01)
*A62C 35/62* (2006.01)

(52) U.S. Cl.
CPC ..... *A62C 37/14* (2013.01); *A62C 35/62* (2013.01); *A62C 37/40* (2013.01)

(58) Field of Classification Search
CPC ..... A62C 35/68; A62C 37/40; A62C 37/14
USPC ..... 169/17, 16, 20, 43, 56, 60, 61
See application file for complete search history.

(56) References Cited

U.S. PATENT DOCUMENTS 3,834,463 A * 9/1974 Allard ..... A62C 37/10 169/28
4,984,637 A * 1/1991 Finnigan ..... A62C 37/40 169/19
5,117,916 A * 6/1992 Ohta ..... A62C 37/10 169/17
5,720,351 A 2/1998 Beukema et al.
5,979,565 A * 11/1999 Wicks ..... A62B 13/00 169/17
5,992,532 A 11/1999 Ramsey et al.
6,047,694 A * 4/2000 Landstrom ..... A47J 27/04 126/25 C
7,185,711 B2 3/2007 Jackson et al.
7,383,892 B2 6/2008 Jackson
7,389,824 B2 6/2008 Jackson
8,297,370 B2 10/2012 Wilkins et al.
8,668,023 B2 3/2014 Wilkins et al.
(Continued)

FOREIGN PATENT DOCUMENTS

WO 2006082634 A1 8/2006

*Primary Examiner* — Jason Boeckmann
*Assistant Examiner* — Joel Zhou
(74) *Attorney, Agent, or Firm* — Brunet & Co. Ltd.; Robert A. H. Brunet; Hans Koenig

(57) ABSTRACT

A double interlock pre-action sprinkler head has a pipe having an inlet and outlet to permit flow of fire suppressant fluid through the pipe. A dedicated electrically actuatable valve is connected to the pipe to prevent fire suppressant fluid in sprinkler system piping from entering the pipe. The electrically actuatable valve opens in response to a signal from a fire detector to permit fire suppressant fluid to flow into the pipe. A heat-sensitive valve is connected to the pipe and opens to permit fire suppressant fluid to exit the pipe when ambient temperature at the heat-sensitive valve is at or above a predefined temperature. The sprinkler head provides a dry pipe solution for a single room while being fully integratable into any building-wide sprinkler system, including wet pipe systems.

19 Claims, 4 Drawing Sheets

(56) References Cited

U.S. PATENT DOCUMENTS

| | | | | |
|---|---|---|---|---|
| 2006/0021759 | A1 | 2/2006 | Golinveaux | |
| 2006/0021760 | A1 | 2/2006 | Golinveaux | |
| 2006/0021761 | A1 | 2/2006 | Golinveaux | |
| 2006/0021762 | A1 | 2/2006 | Golinveaux | |
| 2006/0021763 | A1 | 2/2006 | Golinveaux | |
| 2007/0028951 | A1 | 2/2007 | Huang | |
| 2012/0325502 | A1* | 12/2012 | Hennegan | A62C 35/68 169/16 |
| 2014/0374125 | A1* | 12/2014 | Johnson | A62C 35/68 169/16 |

* cited by examiner

PRE-ACTION SPRINKLER HEAD

CROSS-REFERENCE TO RELATED APPLICATIONS

The present application claims the benefit of U.S. Provisional Patent Application Ser. No. 62/079,691 filed Nov. 14, 2014.

FIELD

This application relates to sprinkler heads for sprinkler systems.

BACKGROUND

Sprinkler systems are used in buildings as fire protection measures. There are three basic types of fire protection sprinkler systems: wet pipe systems, dry pipe systems and deluge systems.

Wet pipe systems are more common than all other types of sprinkler systems. They are the most reliable because they are simple, with the only operating components being automatic sprinkler heads and (commonly, but not always) an automatic alarm check valve. An automatic water supply provides water under pressure to the system piping.

Dry pipe systems are generally installed in spaces in which the ambient temperature may be cold enough to freeze the water in a wet pipe system, rendering the system inoperable. Dry pipe systems are most often used in unheated buildings, in parking garages, in outside canopies attached to heated buildings (in which a wet pipe system would be provided), or in refrigerated coolers. Dry pipe systems are the second most common sprinkler system type. In a dry pipe system, water is not present in the piping until the system operates. The piping is filled with air below the water supply pressure. To prevent the larger water supply pressure from forcing water into the piping, a dry pipe valve (a specialized type of check valve) provides a greater force on top of the check valve clapper by use of a larger valve clapper area exposed to the piping air pressure, as compared to the higher water pressure but smaller clapper surface area. When one or more of the automatic sprinkler heads is exposed, for a sufficient time, to a temperature at or above the temperature rating, it opens, allowing the air in the piping to vent through that sprinkler head. Each sprinkler head operates individually. As the air pressure in the piping drops, the pressure differential across the dry pipe valve changes, allowing water to enter the piping system. Water flow from sprinkler heads is delayed until the air is vented from the sprinkler system piping. Dry pipe sprinkler systems may be advantageous for protection of valuable collections and other water sensitive areas. In a wet system, piping may slowly leak water without attracting notice, while dry pipe systems might not fail in this manner. However, dry pipe systems require additional control equipment and air pressure supply components which increases system complexity. This puts a premium on proper maintenance, as this increase in system complexity results in an inherently less reliable overall system (i.e., more single failure points) as compared to a wet pipe system. The added complexity also impacts the overall dry pipe installation cost, and increases maintenance expenditure primarily due to added service labor costs. Further, regulatory requirements limit the maximum permitted size of individual dry pipe systems, unless additional components and design efforts are provided to limit the time from sprinkler system activation to water discharge to under one minute. These limitations may increase the number of individual sprinkler zones (i.e., served from a single riser) that must be provided in the building, and impact the ability to make system additions. Furthermore, because the piping is empty at the time the sprinkler system operates, there is an inherent time delay in delivering water to the sprinkler heads which have operated while the water travels from the riser to the sprinkler, partially filling the piping in the process. This delay in fire suppression results in a larger fire prior to control, increasing property damage. Following operation or testing, dry pipe sprinkler system piping is drained, but residual water collects in piping low spots, and moisture is also retained in the atmosphere within the piping. This moisture, coupled with the oxygen available in the compressed air in the piping, increases pipe internal wall corrosion rates, possibly eventually leading to leaks. The internal pipe wall corrosion rate in wet pipe systems (in which the piping is constantly full of water) is much lower, as the amount of oxygen available for the corrosion process is lower. Corrosion can be combated with galvanized steel pipe which is less susceptible to corrosion, or by using dry nitrogen to pressurize the system rather than air. These additional precautions increase the cost of the system, but can help prevent system failure and premature need for system replacement.

Deluge systems are systems in which all sprinkler heads connected to the water piping system are open. These systems are used for special hazards where rapid fire spread is a concern, as they provide a simultaneous application of water over the entire hazard. They are sometimes installed in personnel egress paths or building openings to slow travel of fire. Water is not present in the piping until the system operates. Because the sprinkler head orifices are open, the piping is at atmospheric pressure. To prevent the water supply pressure from forcing water into the piping, a deluge valve is used in the water supply connection, which is a mechanically latched valve. It is a non-resetting valve, and stays open once tripped. Because the heat sensing elements present in the automatic sprinkler heads have been removed, the deluge valve must be opened as signaled by a fire alarm system. The type of fire alarm initiating device is selected mainly based on the hazard (e.g., smoke detectors, heat detectors, or optical flame detectors). The initiation device signals the fire alarm panel, which in turn signals the deluge valve to open. Activation can also be manual, depending on the system goals. Manual activation is usually via an electric or pneumatic fire alarm pull station, which signals the fire alarm panel, which in turn signals the deluge valve to open.

Pre-action sprinkler systems are known in the art for use in locations where accidental activation of the sprinkler system is undesired, such as in museums with rare art works, manuscripts, or books; and data centers, for protection of computer equipment from accidental water discharge. Pre-action systems are hybrids of wet, dry, and deluge systems, depending on the exact system goal. There are two main sub-types of pre-action systems: single interlock, and double interlock.

The operation of single interlock systems is similar to dry systems except that these systems require that a preceding fire detection event, typically the activation of a heat or smoke detector, takes place prior to the action of water introduction into the system's piping by opening the pre-action valve, which is a mechanically latched valve (i.e., similar to a deluge valve). In this way, the system is essentially converted from a dry system into a wet system. The intent is to reduce the undesirable time delay of water delivery to sprinklers that is inherent in dry systems. Prior to fire detection, if the sprinkler operates, or the piping system develops a leak, loss of air pressure in the piping will activate a trouble alarm. In this case, the pre-action valve will not open due to loss of supervisory pressure, and water will not enter the piping.

The operation of double interlock systems is similar to deluge systems except that automatic sprinkler heads are used. These systems require that both a preceding fire detection event, typically the activation of a heat or smoke detector, and an automatic sprinkler head operation take place prior to the action of water introduction into the system's piping. Activation of either the fire detectors alone, or sprinklers alone, without the concurrent operation of the other, will not allow water to enter the piping. Because water does not enter the piping until a sprinkler head operates, double interlock systems are considered as dry systems in terms of water delivery times, and similarly require a larger design area.

A sprinkler head is the component of a fire sprinkler system that discharges water when the effects of a fire have been detected, such as when a predetermined temperature has been exceeded. Each sprinkler head is held closed by a heat-sensitive glass bulb or a two-part metal link held together with fusible alloy such as Wood's metal and other alloys with similar compositions. The glass bulb or link applies pressure to a pipe cap which acts as a plug to prevent water from flowing until the ambient temperature around the sprinkler head reaches an activation temperature. Because each sprinkler head activates independently when the activation temperature is reached, the number of sprinkler heads that operate is limited to only those near the fire, thereby maximizing the available water pressure over the point of fire origin. In glass bulb-type sprinkler heads, the bulb breaks as a result of the thermal expansion of the liquid inside the bulb. The time it takes before a bulb breaks is dependent on the temperature. Below the design temperature, it does not break, and above the design temperature it breaks, taking less time to break as temperature increases above the activation temperature.

In many cases, it is desirable to generally protect a building from fire using a simple wet pipe sprinkler system, while protecting certain special rooms (e.g. water sensitive or unheated rooms) in the building using a dry pipe system. It is currently possible to install separate systems, a wet pipe system for most of the building and a separate dry pipe system for the special rooms. However, this approach increases expense, complicates maintenance and results in separated fire protection zones that must be separately controlled and monitored thereby duplicating fire protection efforts for just a few rooms.

There remains a need in the art for a simple, effective way for providing dry pipe fire protection for a smaller area (e.g. for one room) that is integratable into any other building-wide sprinkler system, including wet pipe systems.

SUMMARY

It has now been found that an individual sprinkler head may be designed as a pre-action sprinkler head providing a dry pipe solution for a single room while being fully integratable into any building-wide sprinkler system, including wet pipe systems.

In one aspect, there is provided a double interlock pre-action sprinkler head comprising: a pipe having an inlet and an outlet configured to permit flow of fire suppressant fluid through the pipe from the inlet to the outlet; a dedicated electrically actuatable valve connected to the pipe and configured to prevent fire suppressant fluid in sprinkler system piping from entering the pipe through the inlet, the electrically actuatable valve actuatable in response to a signal from a fire detector to permit fire suppressant fluid in the sprinkler system piping to flow through the inlet into the pipe; and, a heat-sensitive valve connected to the pipe, the heat-sensitive valve actuatable from a closed state in which fire suppressant fluid in the pipe is prevented from exiting the pipe through the outlet to an open state in which fire suppressant fluid in the pipe is permitted to exit the pipe through the outlet, the heat-sensitive valve actuating from the closed state to the open state when ambient temperature at the heat-sensitive valve is at or above a predefined temperature.

In another aspect, there is provided a sprinkler system comprising a sprinkler head as defined above and sprinkler system piping in fluid communication with the electrically actuatable valve, the piping configured to transport fire suppressant fluid to the electrically actuatable valve.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1:
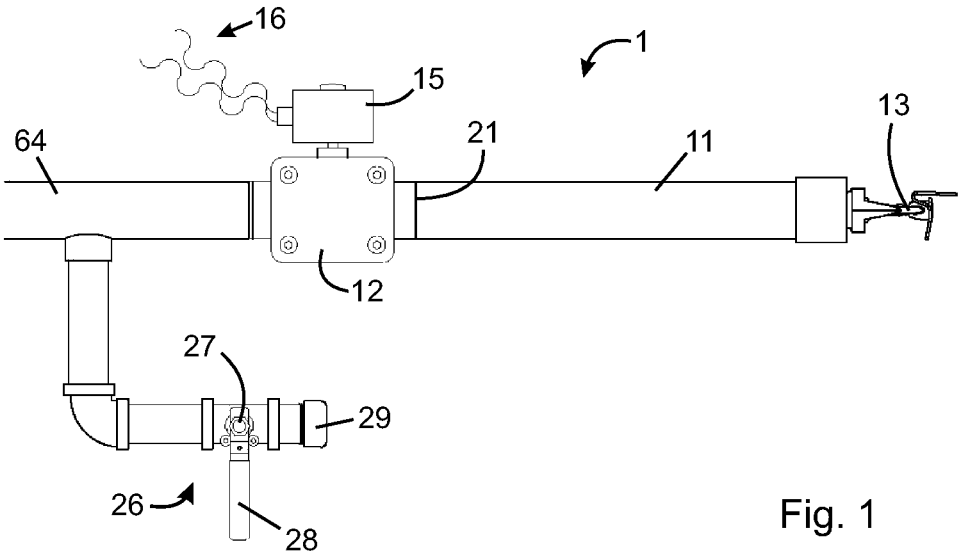
FIG. 1 depicts a first embodiment of a sprinkler head in accordance with the present disclosure.

The double interlock pre-action sprinkler head comprises a pipe, a dedicated electrically actuatable valve connected to the pipe and a heat-sensitive valve connected to the pipe. The sprinkler head may further comprise a drain valve with a drain outlet. Any two or more of the parts of the sprinkler head may be releasably connected or may be formed into a non-separable unit. Releasable connections may include mating screw threads, locatable connections (e.g. bayonet connections) and the like. The connection may be locatable to align monitoring features associated with the sprinkler head. A non-separable unit may be formed, for example, from: the electrically actuatable valve, the drain valve and the drain outlet; the electrically actuatable valve and the pipe; or the electrically actuatable valve, the drain valve, the drain outlet and the pipe. A non-separable unit may be adapted to connect directly to sprinkler system piping; therefore, forming parts of the sprinkler head into a non-separable unit facilitates installation while helping reduce the likelihood of the sprinkler head leaking.

The electrically actuatable valve may be any suitable valve in the plumbing arts that is openable and closable by an electrical signal. One preferred example is a solenoid valve. Suitable electrically actuatable valves, including solenoid valves, are commercially available, for example from Parker Hannifin Corporation, Skinner Valve Division or Automatic Switch Company (ASCOA).

The electrically actuatable valve is dedicated to a single sprinkler head. One electrically actuatable valve may be used to control flow of fire suppression fluid (e.g. water, foam, and the like) to the pipe of a single sprinkler head. Use of a dedicated electrically actuatable valve for each sprinkler head permits the installation of double interlock pre-action sprinkler protection on an area-by-area basis, for example on a room-by-room basis. In this manner, special rooms such as data centers, water sensitive rooms (e.g. museum rooms, archives), unheated rooms) and the like may be protected with the assurance of double interlock fail-safe measures while the remainder of the building may be protected with less fail-safe measures, for example a wet pipe system.

Because the sprinkler head is a double interlock pre-action measure unto itself, the sprinkler heads can be integrated into any existing sprinkler systems (e.g. wet pipe systems, dry pipe systems, etc.) without the need to install an entirely separate system just for a few areas. Therefore, there would be no need for separated fire protection zones that must be separately controlled and monitored. Further, existing sprinkler systems can be retrofitted with the sprinkler heads described herein thereby reducing replacement costs when outfitting the building with double interlock pre-action sprinkler protection. It is a particular advantage that the sprinkler heads may be connected to a wet pipe system while providing dry double interlock pre-action protection to selected areas of the building.

Heat sensitive valves for use in sprinkler heads are known in the art. For example, the heat-sensitive valve may comprise a fluid-filled glass bulb or a fusible metal link. Fluid in the glass expands when subjected to heat, and when a predefined ambient temperature is reached around the glass bulb, the fluid has expanded sufficiently to break the glass bulb thereby releasing movement of other components of the valve to open the valve. Fluid-filled glass bulbs are often used with pendent sprinkler heads, i.e. sprinkler heads that point vertically from a ceiling. Likewise, a fusible metal link will melt at a predefined temperature allowing movement of other components of the valve to open the valve. Fusible metal links are often used with sidewall sprinkler heads, i.e. sprinkler heads that point horizontally from a wall. The heat sensitive valve may be purchased commercially in association with the pipe in the form of an existing dry-type sprinkler head (e.g. a Tyco D5-1 dry-type sprinkler) and integrated with an electrically actuatable valve to form a double interlock pre-action sprinkler head of the present invention.

The sprinkler head may further comprise a drain valve and a drain outlet, the drain valve opening and closing a drain outlet. The drain valve and outlet may be disposed between the electrically actuatable valve and the heat-sensitive valve. The drain valve may be actuatable between a closed position whereby fire suppressant fluid in the pipe is prevented from exiting the drain valve and an open position whereby fire suppressant fluid in the pipe is permitted to exit the drain valve. When the drain valve is in the open position, fluid flow from the electrically actuatable valve into the pipe may be prevented. The drain valve is useful for testing whether there is fluid in the pipe and for draining any fluid that may be in the pipe.

The sprinkler head may be associated with a manual by-pass. The manual by-pass may comprise a by-pass valve together with piping for diverting fluid from behind the electrically actuatable valve through the by-pass valve to a by-pass drain outlet. The by-pass drain outlet may be fluidly connected to the drain valve, if desired. The by-pass valve is normally closed, and is preferably monitored to provide an indication to the controller of the state of the by-pass valve. The manual by-pass may be useful for draining sprinkler system piping in the event that the electrically actuatable valve fails, and is often required by building codes applicable to sprinkler systems.

Sprinkler heads may be pendent, upright or horizontal sidewall in design depending on the type of area to be protected. The sprinkler heads are especially suited for horizontal sidewall applications.

In the double interlock sprinkler head, two events are needed to cause flow of fire suppression fluid into an area being protected: the electrically actuatable valve must open and the heat-sensitive valve must open. The dedicated electrically actuatable valve is configured to prevent fire suppressant fluid in sprinkler system piping from entering the pipe through the inlet, but is electrically actuatable in response to a signal from a fire detector to permit fire suppressant fluid in the sprinkler system piping to flow through the inlet into the pipe. Thus, the electrically actuatable valve may be monitored and controlled for being opened and closed. Any suitable fire detector may be employed, for example a heat detector, a smoke detector or a flame detector. Heat detectors sense the presence of fire as the temperature of surroundings exceeds the predefined temperature or the rate of temperature rise shoots up. Heat detectors may be a mechanical type or an electronic type. Smoke detectors measure the concentration of solid or liquid particles in a specified area. As the concentration of these particles in air increases beyond a certain value, the smoke detector signals a fire. Smoke detectors may be ionization type or photoelectric type. Flame detectors sense the occurrence of fire by sensing the presence of light, generally using a light sensitive receiving element for fire detection.

Signals from the fire detector to the electrically actuated valve may be transmitted through wires or wirelessly. Further, the signals may be transmitted directly to the electrically actuated valve from the fire detector, in which case the electrically actuated valve may comprise a processor to process the signals into commands for the valve. Alternatively or additionally, the signals may be transmitted to a controller in a releasing panel, the controller interpreting signals from both the fire detector and the electrically actuated valve and transmitting signals to the electrically actuated valve in order to monitor both the fire detector and the electrically actuated valve and to control the electrically actuated valve. The releasing panel may be in electronic communication with a fire alarm panel, from which control may be accomplished and/or status of the entire fire protection system including the sprinkler system may be monitored.

In addition to monitoring the electrically actuated valve and/or fire detector, the status of the heat-sensitive valve may also be monitored. Monitoring both the electrically actuated valve and the heat sensitive valve is a dual-monitoring regime, which is particularly preferred. Monitoring of the heat sensitive valve may be accomplished with a state detector. The state detector may comprise any suitable structure for determining whether the heat sensitive valve is open or closed. The state detector may monitor the structural integrity of the head in some cases where actuation of the heat sensitive valve involves breaking the head. The state detector may be in electronic communication with a controller for monitoring the state of the heat sensitive valve. The controller may the same or different as the controller with which the electrically actuated valve is in electronic communication. Preferably, the same controller monitors both the electrically actuated valve and the heat sensitive valve. Some examples of state detectors include an electrical circuit, an optical element (e.g. an optical relay), a wireless transceiver, a plug, and the like. An electrical circuit may comprise a wire having a current flowing therein. An interruption in the electrical circuit, for example a circuit break, may indicate actuation of the heat-sensitive valve from the closed state to the open state. An optical element may comprise a photodetector. A change in the optical element, for example a change in the incident light on a photodetector, may indicate actuation of the heat-sensitive valve from the closed state to the open state. A light source (e.g. a directional light source, for example a laser) may be used in conjunction with a photodetector.

Monitoring the electrically actuated valve and/or fire detector and the heat-sensitive valve permits the controller to better assess the real conditions in an area being protected. With the electrically actuated valve, fire detector and the state detector in electronic communication with a controller and configured to provide and/or receive electronic signals to and/or from the controller, the controller may configured to open the electrically actuatable valve when the fire detector signals existence of a fire and the state detector signals that the heat-sensitive valve is in the open state, and keep the electrically actuatable valve closed when the fire detector is not signaling existence of a fire but the state detector signals that the heat-sensitive valve is in the open state. When the fire detector signals existence of a fire and the state detector signals that the heat-sensitive valve is in the open state, there is very probably a fire in the area being protected and the electronically activated valve would be opened and fire suppression fluid would be free to flow through the pipe into the area being protected. When the fire detector is not signaling existence of a fire but the state detector signals that the heat-sensitive valve is in the open state, there is the possibility that the heat sensitive valve has been mistakenly actuated (e.g. through breakage), in which case keeping the electronically activated valve closed saves the area from being erroneously flooded with fire suppression fluid. On the other hand, when the fire detector is not signaling existence of a fire but the state detector signals that the heat-sensitive valve is in the open state, there is the possibility that the fire detector is broken, in which case an operator is forewarned and has a chance to determine whether there is in fact a fire and then release the electrically actuatable valve so that the sprinkler system may combat the fire.

The aforementioned electronically operated double interlock is thus useful for providing information and warnings about the true state of an area being protected, and for taking measures to combat a fire when necessary but preventing an erroneous activation of the sprinkler system in area being protected. As previously indicated, the double interlock pre-action sprinkler head makes the possible in the context of individually designated special areas without the need for installing two or more completely separate sprinkler systems. Dual-monitoring helps reduce erroneous activation of the sprinkler head while providing information about possible malfunctions in the fire detector, the electrically actuatable valve and/or heat-sensitive valve.

One embodiment of a sprinkler head 1 in accordance with the present disclosure is shown in FIG. 1. The sprinkler head 1 is a sidewall sprinkler head that comprises a pipe 11 having a proximal end at which a solenoid valve 12 is connected, and a distal end at which a fusible metal link 13 is mounted, the metal link 13 being part of a heat-sensitive valve at the distal end of the pipe 11. The solenoid valve 12 is directly connected to the pipe 11 by a releasable connection 21, for example mating screw threads, a bayonet connection, and the like. The solenoid valve 12 comprises a switch 15 in electronic communication through wires 16 to a releasing panel (see FIG. 6), the releasing panel comprising a controller for controlling the solenoid valve 12. Instead of wires 16, electronic communication between the solenoid valve 12 and the releasing panel may be accomplished wirelessly. The pipe 11 may be adapted from any suitable existing sprinkler head, for example a Series DS-1 standard response dry-type sprinkler assembly from Tyco. Associated with the sprinkler head 1 is a manual by-pass 26 in fluid communication with a connecting pipe 64 that connects the solenoid valve 12 to sprinkler system piping. The manual by-pass 26 comprises a by-pass valve 27, for example a three-way ball valve comprising a by-pass drain outlet 29 and a handle 28 for manually opening and closing the by-pass drain outlet 29. The manual by-pass 26 permits draining of sprinkler system piping, in the event the solenoid valve 12 fails.

Figure 2:
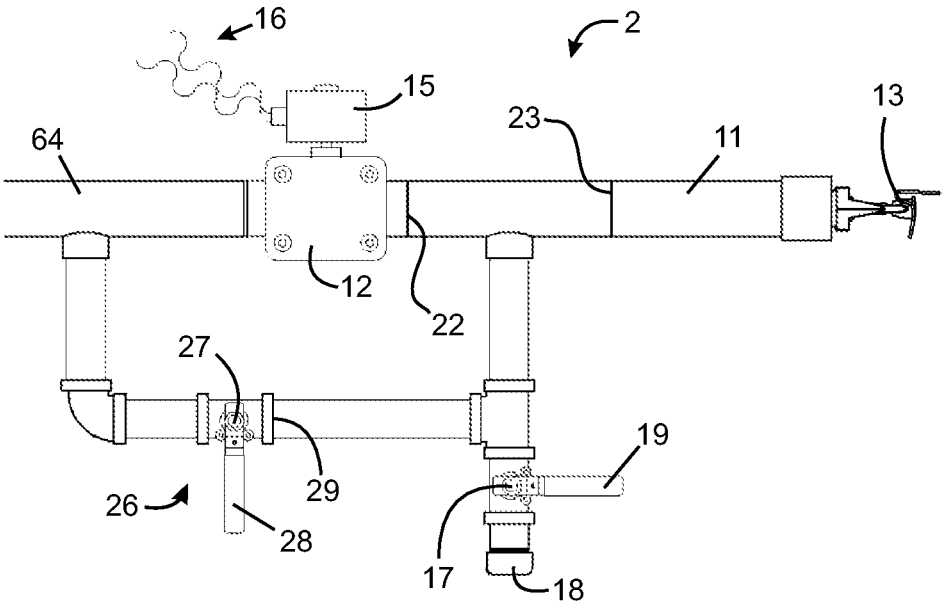
FIG. 2 depicts a second embodiment of a sprinkler head in accordance with the present disclosure.

Another embodiment of a sprinkler head 2 in accordance with the present disclosure is shown in FIG. 2. The sprinkler head 2 is also a sidewall sprinkler head that comprises the pipe 11, the solenoid valve 12 and the fusible metal link 13. However, instead of a direct connection between the pipe 11 and the solenoid valve 12, a drain/test valve 17 is disposed between the pipe 11 and the solenoid valve 12. The drain/test valve may be, for example, a three-way ball valve comprising a drain outlet 18 and a handle 19 for manually opening and closing the drain outlet 18. The solenoid valve 12 is directly connected to a proximal end of the drain/test valve 17 by a releasable connection 22, for example mating screw threads, a bayonet connection, and the like. The pipe 11 is directly connected to a distal end of the drain/test valve 17 by a releasable connection 23, for example mating screw threads, a bayonet connection, and the like. The drain/test valve 17 is normally configured to be in fluid communication with both the solenoid valve 12 and the pipe 11 to permit fluid to flow from the solenoid valve 12 into the pipe 11. When the drain/test valve 17 is opened to the drain outlet 18, the drain/test valve 17 permits any fluid to flow out of the pipe 11 through the drain outlet 18, but closes fluid communication between the solenoid valve 12 and the drain/test valve 17, and hence prevents fluid flow from the solenoid valve 12 to the pipe 11. The drain/test valve 17 may this be used to test whether the pipe 11 contains fire suppressant fluid (e.g. water) and/or to drain fire suppressant fluid from the pipe 11. Furthermore, the by-pass drain outlet 29 is in fluid communication with the drain outlet 18. Therefore, in the event of a failure of the solenoid valve 12, both the by-pass valve 27 and the drain/test valve 17 would need to be opened to manually drain the sprinkler system piping.

Figure 3:
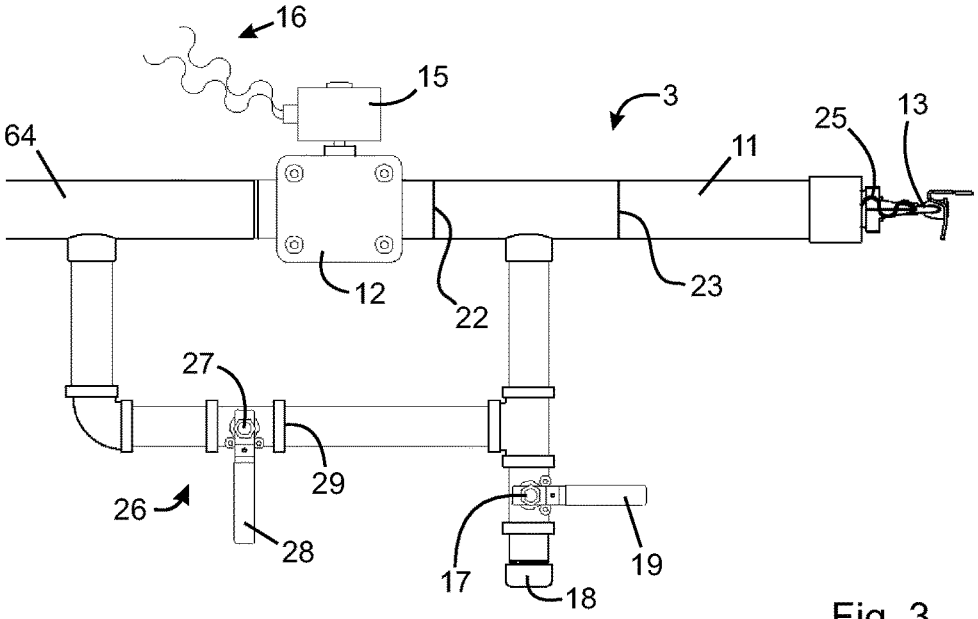
FIG. 3 depicts a third embodiment of a sprinkler head in accordance with the present disclosure.

Another embodiment of a sprinkler head 3 in accordance with the present disclosure is shown in FIG. 3. The sprinkler head 3 is the same as the sprinkler head 2 shown in FIG. 2 except that the fusible metal link 13 is equipped with a monitor wire 25 for monitoring the condition of the metal link 13. The monitor wire 25 is in electronic communication with the controller in the releasing panel, either through wires or wirelessly. Fusing of the metal link 13 causes the monitor wire 25 to break, thereby breaking current flowing through the monitor wire 25, which causes a signaled to be sent back to the controller in the releasing panel. In this way, the controller is able to monitor both the solenoid valve 12 and the state of the metal link 13 and take appropriate action on the solenoid valve 12 depending on the signals received from both a fire alarm and the metal link 13. More details of the operation are described in connection with FIG. 6.

Figure 4:
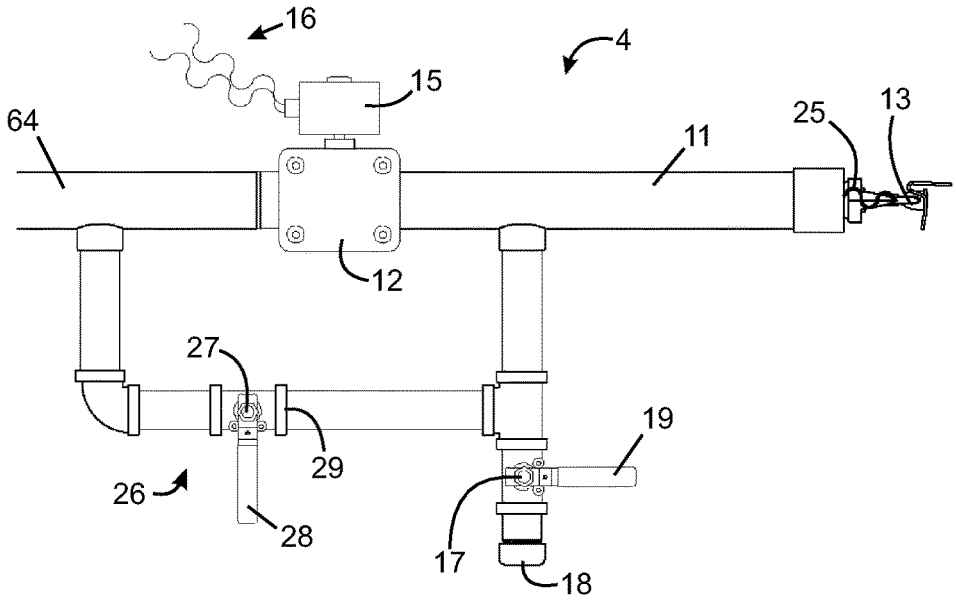
FIG. 4 depicts a fourth embodiment of a sprinkler head in accordance with the present disclosure.

Another embodiment of a sprinkler head 4 in accordance with the present disclosure is shown in FIG. 4. The sprinkler head 4 is the same as the sprinkler head 3 shown in FIG. 3 except that the entire sprinkler head 4 is formed as a unitary whole. The solenoid valve 12, the drain/test valve 17 and the pipe 11 are formed as one inseparable piece. Forming these components as one piece reduces the chance of leakage at connections between the pieces and facilitates installation of the sprinkler head.

Figure 5:
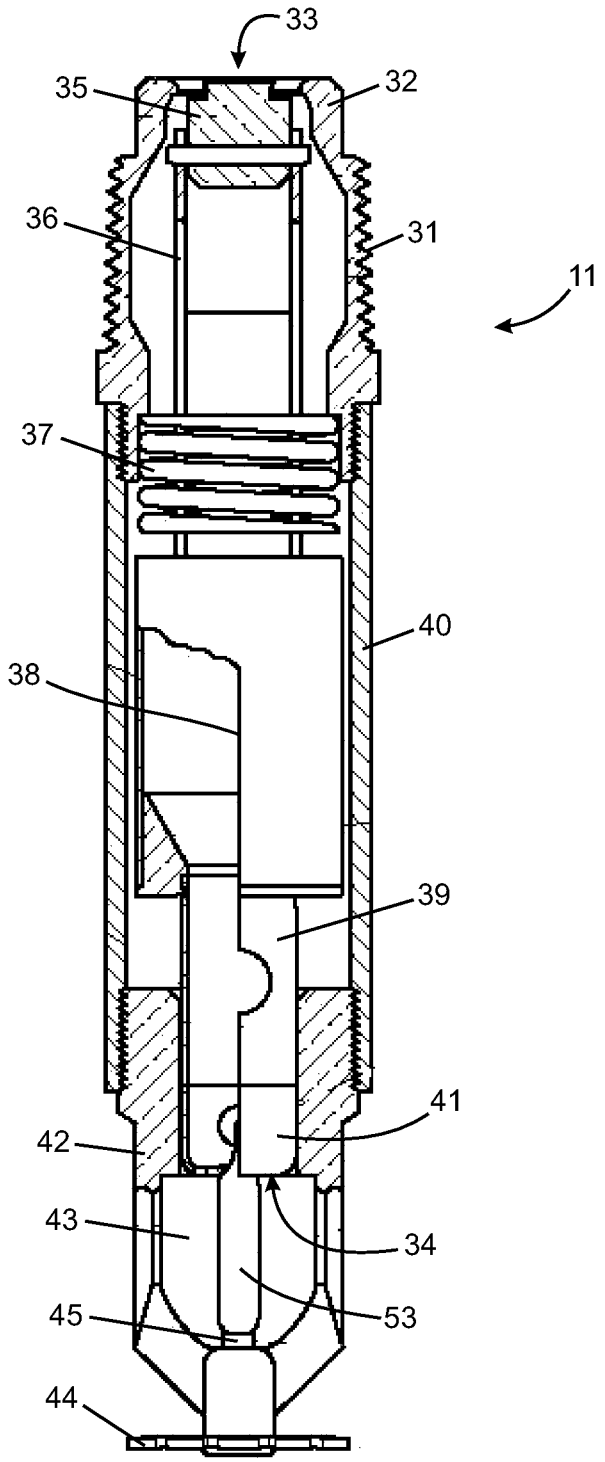
FIG. 5 depicts interior details of a pipe of a sprinkler head.

FIG. 5 depicts an example of interior details of the pipe 11, in this case the pipe 11 having screw threads 31 for connection to the solenoid valve or the drain/test valve. The pipe 11 comprises an inlet 32 threadingly mated to a casing 40, the inlet 32 having an inlet orifice 33 at a proximal end of the pipe 11, the inlet orifice 33 in fluid communication with either a solenoid valve or a drain/test valve. A plug 35 with a seal seals the inlet orifice 33 and a yoke 36 attached to a compressed coiled spring 37 holds the plug 35 in place to block the inlet orifice 33. A water tube 38 and a guide tube 39 are nested concentrically within the casing 40, the guide tube 39 seated against a proximal end of a seat 41 on which a glass bulb 53 is seated. An outlet orifice 34 is located at a distal end of the pipe 11 where the glass bulb 53 is seated on the seat 41. A frame 42 is threadingly mated with the casing 40 at a distal end of the casing 40, the frame 42 comprising a deflector 44 positioned at a distal end of the glass bulb 53. The frame 42 further comprises a vent hole 43 within which the glass bulb 53 is disposed. A proximal end of the glass bulb 53 is seated on the seat 41 while the distal end of the glass bulb 53 is seated on a compression screw 45 mounted on the frame 42 at a distal end of the vent hole 43. While FIG. 5 illustrates a pendent sprinkler head with a fluid-filled glass bulb, the inner workings of the sprinkler head are the same for a sidewall sprinkler head with a fusible metal link. Besides comprising a fusible metal link rather than a glass bulb, a sidewall sprinkler head also comprises a differently shaped deflector as illustrated in FIGS. 1-4.

Referring to FIGS. 1-5, under normal conditions the solenoid valve 12 is closed and the fusible metal link 13 is intact. Where a drain/test valve 17 is present, the drain/test valve 17 is normally configured to permit fluid flow from the solenoid valve 12 to the pipe 11. With the solenoid valve 12 closed, fire suppressant fluid may not enter the pipe 11 through the inlet orifice 33. Thus, the pipe is dry. In the event of a fire, a signal from the controller in the releasing panel (see FIG. 6) causes the switch 15 of the solenoid valve 12 to open the solenoid valve 12 thereby permitting fire suppressant fluid to flow to the pipe 11. Normally, fire suppressant fluid is prevented from entering the pipe 11 by the plug 35 sealing the inlet orifice 33. However, the metal link 13 comprises a metal that melts/fuses when exposed to heat at a predefined temperature. Fusing of the metal link 13 releases the seat 41, which is then free to be moved through the outlet orifice 34. The compressed coiled spring 37 is then permitted to expand, and expansion of the spring 37 pushes the water tube 38 and the guide tube 39 distally. Simultaneously, the yoke 36 is pulled distally withdrawing the plug 35 from the inlet orifice 33 allowing fire suppressant fluid to flow into the pipe 11 through the inlet orifice 33 and out of the pipe 11 through the outlet orifice 34.

Figure 6:
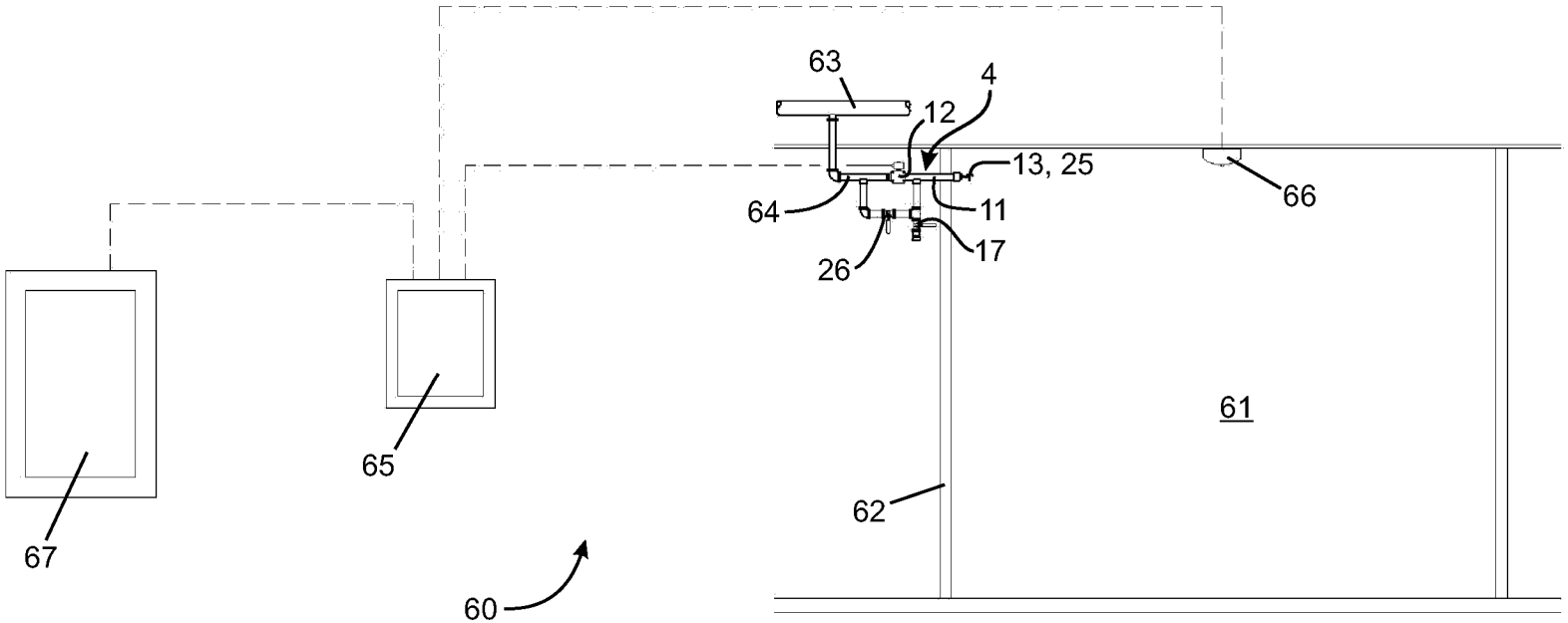
FIG. 6 depicts a sprinkler system including a sprinkler head in accordance with the present disclosure.

FIG. 6 depicts a sprinkler system 60 including a sprinkler head 4 in accordance with the present disclosure. The sprinkler head 4 comprises the pipe 11, solenoid valve 12, fusible metal link 13 and drain/test valve 17 as previously described in connection with FIGS. 1-4. The sprinkler head 4 is associated with the manual by-pass 26 as previously described in connection with FIGS. 2-4. The sprinkler head 4 is mounted on a wall 62 of a room 61 to be protected. The sprinkler head 4 is oriented horizontally with only the distal end of the pipe 11 with the fusible metal link 13 protruding through the wall 62. The majority of the pipe 11 is not in the room 61, therefore even if there was fire suppressant fluid in the pipe 11 there would be little danger of a leak in the pipe 11 causing water to enter the room 61.

The sprinkler head 4 is in fluid communication with sprinkler system piping 63 through the connecting pipe 64 that connects the sprinkler system piping 63 to the solenoid valve 12. The sprinkler system piping 63 is part of a building-wide sprinkler system, which may be a wet pipe system, a dry pipe system or any other type of system. Thus, for each sprinkler head there is one solenoid valve dedicated to the sprinkler head, which permits the use of any kind of sprinkler system in the building as a whole while providing the ability to provide double interlock pre-action sprinkler protection on a room-by-room basis. Further, only one kind of sprinkler system is required for the building as a whole because the sprinkler head permits double interlock pre-action sprinkler protection for any individual space in the building.

The sprinkler system 60 further includes a releasing panel 65 containing a controller, which is in electronic communication (shown in dashed lines) with a fire alarm panel 67, the solenoid valve 12, the monitor wire 25 associated with the fusible metal 13 and a fire detector 66 located in the room 61. The fire alarm panel 67 is the main panel for the sprinkler system 60, whereas the releasing panel 65 monitors and controls the double interlock pre-action sprinkler head 4, and any other double interlock pre-action sprinkler head used in particular rooms of the building.

As discussed above, under normal conditions the solenoid valve 12 is closed and the fusible metal link 13 is intact. In the event of a real fire, the fire detector 66 sends a signal to the releasing panel 65 that a fire has started in the room 61. This signal prompts the releasing panel 65 to signal the solenoid valve 12 to open to permit fire suppressing fluid to flow from the sprinkler system piping 63 through the solenoid valve 12 to the pipe 11. The releasing panel 65 may also send a signal to the fire alarm panel 67 that a fire has started in the room 61, which may be indicated on the fire alarm panel 67 in any suitable manner, for example with illuminated lights. Because there is a real fire event, ambient temperature in the room is elevated until the temperature is sufficient to cause the fusible metal link 13 to fuse. Fusing of the fusible metal link 13 opens the pipe 11 to allow pressurized fire suppression fluid to flow into the pipe 11 through the inlet orifice and out of the pipe 11 through the outlet orifice to spray the room and fire therein with fire suppression fluid.

Because the releasing panel 65 is in electronic communication with the monitor wire 25, fusing of the fusible metal link 13 causes a signal to be sent from the monitor wire 25 to the releasing panel 65, which is an indication that the fusible metal link 13 has fused. If no signal is sent by the monitor wire 25 that the fusible metal link 13 is fused, but the releasing panel 65 has received a fire signal from the fire detector 66, a warning may be raised on the alarm panel that there may be a malfunction either with the fire detector 66 or with the fusible metal link 13. If the fusible metal link 13 has not fused, then no fire suppression fluid will be able to leave the pipe 11. If the fire detector 66 raised a false alarm, the room 61 would be spared from being flooded with fire suppression fluid. If there actually is a fire, operators will be able to take steps to ensure that the fusible metal link 13 is fused to permit spraying the room with fire suppression fluid.

In some cases, the fusible metal link 13 may be broken even if there is no fire. In such a case, if there is no signal from the fire detector 66 that a fire is occurring, the releasing panel 65 would not open the solenoid valve 12 thereby sparing the room 61 from an accidental flooding of fire suppression fluid. The monitor wire 25 would notify the releasing panel 65 that the fusible metal link 13 is broken and maintenance measures can be initiated in a timely manner.

The novel features will become apparent to those of skill in the art upon examination of the description. It should be understood, however, that the scope of the claims should not be limited by the embodiments, but should be given the broadest interpretation consistent with the wording of the claims and the specification as a whole.

The invention claimed is:

1. A double interlock pre-action sprinkler head comprising:

a pipe having an inlet at a proximal end and an outlet, the pipe configured to permit flow of a fire suppressant fluid through the pipe from the inlet to the outlet;

a dedicated electrically actuatable valve connected to the inlet in direct contact with the proximal end of the pipe and configured to prevent fire suppressant fluid in a sprinkler system piping from entering the pipe through the inlet, the electrically actuatable valve actuatable in response to a signal from a fire detector to permit fire suppressant fluid in the sprinkler system piping to flow through the inlet into the pipe; and, only one heat-sensitive valve connected to the outlet of the pipe, the dedicated electrically actuatable valve dedicated to the one heat-sensitive valve, the heat-sensitive valve actuatable from a closed state in which fire suppressant fluid in the pipe is prevented from exiting the pipe through the outlet to an open state in which fire suppressant fluid in the pipe is permitted to exit the pipe through the outlet, the heat-sensitive valve actuating from the closed state to the open state when ambient temperature at the heat-sensitive valve is at or above a predefined temperature, the double interlock pre-action sprinkler head connectable into an existing sprinkler system, wherein the heat-sensitive valve further comprises a state detector configured to monitor the state of the heat-sensitive valve and wherein the state detector comprises an optical element and a change in the optical element indicates actuation of the heat-sensitive valve from the closed state to the open state.

2. A double interlock pre-action sprinkler head comprising:

a pipe having an inlet at a proximal end and an outlet, the pipe configured to permit flow of a fire suppressant fluid through the pipe from the inlet to the outlet;

a dedicated electrically actuatable valve connected to the inlet in direct contact with the proximal end of the pipe and configured to prevent fire suppressant fluid in a sprinkler system piping from entering the pipe through the inlet, the electrically actuatable valve actuatable in response to a signal from a fire detector to permit fire suppressant fluid in the sprinkler system piping to flow through the inlet into the pipe; and, only one heat-sensitive valve connected to the outlet of the pipe, the dedicated electrically actuatable valve dedicated to the one heat-sensitive valve, the heat-sensitive valve actuatable from a closed state in which fire suppressant fluid in the pipe is prevented from exiting the pipe through the outlet to an open state in which fire suppressant fluid in the pipe is permitted to exit the pipe through the outlet, the heat-sensitive valve actuating from the closed state to the open state when ambient temperature at the heat-sensitive valve is at or above a predefined temperature, the double interlock pre-action sprinkler head connectable into an existing sprinkler system, wherein the heat-sensitive valve further comprises a state detector configured to monitor the state of the heat-sensitive valve and wherein the fire detector and the state detector are in electronic communication with a controller, the fire detector and the state detector are configured to provide electronic signals to the controller and the controller is configured to:

open the electrically actuatable valve when the fire detector signals existence of a fire and the state detector signals that the heat-sensitive valve is in the open state; and, keep the electrically actuatable valve closed when the fire detector is not signaling existence of a fire but the state detector signals that the heat-sensitive valve is in the open state.

3. The sprinkler head according to claim 1, wherein the electrically actuatable valve comprises a solenoid valve.

4. The sprinkler head according to claim 1, wherein the heat-sensitive valve comprises a fluid-filled glass bulb.

5. The sprinkler head according to claim 1, wherein the heat-sensitive valve comprises a fusible metal link.

6. The sprinkler head according to claim 1, wherein the electrically actuatable valve and the pipe are formed into a non-releasably connected unit.

7. The sprinkler head according to claim 1, further comprising a drain valve and a drain outlet, the drain valve and drain outlet disposed between the electrically actuatable valve and the heat-sensitive valve, the drain valve actuatable between a closed position whereby fire suppressant fluid in the pipe is prevented from exiting the drain valve and an open position whereby fire suppressant fluid in the pipe is permitted to exit the drain valve.

8. The sprinkler head according to claim 7, wherein the electrically actuatable valve, drain valve and drain outlet are formed into a non-releasably connected unit.

9. The sprinkler head according to claim 7, wherein the electrically actuatable valve, drain valve, drain outlet and pipe are formed into a non-releasably connected unit.

10. A sprinkler system comprising the sprinkler head as defined in claim 1 and sprinkler system piping in fluid communication with the electrically actuatable valve, the piping configured to transport fire suppressant fluid to the electrically actuatable valve.

11. The sprinkler head according to claim 1, wherein the heat-sensitive valve further comprises a state detector configured to monitor the state of the heat-sensitive valve.

12. The sprinkler head according to claim 11, wherein the state detector comprises an electrical circuit and an interruption in the electrical circuit indicates actuation of the heat-sensitive valve from the closed state to the open state.

13. The sprinkler head according to claim 2, wherein the electrically actuatable valve comprises a solenoid valve.

14. The sprinkler head according to claim 2, wherein the heat-sensitive valve comprises a fluid-filled glass bulb.

15. The sprinkler head according to claim 2, wherein the heat-sensitive valve comprises a fusible metal link.

16. The sprinkler head according to claim 2, wherein the electrically actuatable valve and the pipe are formed into a non-releasably connected unit.

17. The sprinkler head according to claim 2, further comprising a drain valve and a drain outlet, the drain valve and drain outlet disposed between the electrically actuatable valve and the heat-sensitive valve, the drain valve actuatable between a closed position whereby fire suppressant fluid in the pipe is prevented from exiting the drain valve and an open position whereby fire suppressant fluid in the pipe is permitted to exit the drain valve.

18. The sprinkler head according to claim 17, wherein the electrically actuatable valve, drain valve and drain outlet are formed into a non-releasably connected unit.

19. The sprinkler head according to claim 17, wherein the electrically actuatable valve, drain valve, drain outlet and pipe are formed into a non-releasably connected unit.

* * * * *